United States Patent [19]

Wallman

[11] 4,377,466

[45] Mar. 22, 1983

[54] PROCESS FOR STAGED COMBUSTION OF RETORTED CARBON CONTAINING SOLIDS

[75] Inventor: Per H. Wallman, Berkeley, Calif.

[73] Assignee: Chevron Research Company, San Francisco, Calif.

[21] Appl. No.: 257,700

[22] Filed: Apr. 27, 1981

[51] Int. Cl.[3] ..... C10G 1/00; C10B 49/10

[52] U.S. Cl. ..... 208/11 R; 208/8 R; 201/31

[58] Field of Search ..... 208/11 R

[56] References Cited

U.S. PATENT DOCUMENTS

| | | | |
|---|---|---|---|
| 3,454,383 | 7/1969 | Pirsh et al. | 201/31 X |
| 3,655,518 | 4/1972 | Schmalfeld et al. | 202/108 |
| 3,703,442 | 11/1972 | Rammler et al. | 208/11 R X |
| 4,029,027 | 6/1977 | Smith | 110/28 |
| 4,165,717 | 8/1979 | Reh et al. | 122/4 |
| 4,199,432 | 4/1980 | Tamm et al. | 208/8 |
| 4,243,489 | 1/1981 | Green | 208/11 R X |
| 4,314,899 | 2/1982 | Styring, Jr. | 208/11 R |

*Primary Examiner*—Delbert E. Gantz
*Assistant Examiner*—Glenn A. Caldarola
*Attorney, Agent, or Firm*—D. A. Newell; S. R. LaPaglia; J. W. Ambrosius

[57] ABSTRACT

Staged combustion of a retorted carbon containing solid comprising partially burning residual carbonaceous material in a dilute vertical combustion zone and completing the combustion in a second combustion zone where a second fraction of retorted carbon containing solids is introduced and fines are also removed.

9 Claims, 3 Drawing Figures

PROCESS FOR STAGED COMBUSTION OF RETORTED CARBON CONTAINING SOLIDS

BACKGROUND OF THE INVENTION

Certain naturally occurring carbon containing solids such as oil shale, tar sands, and diatomaceous earth may be retorted to yield an oil useful for producing petroleum products.

Following the pryolysis of the particulate carbon containing solids to extract the volatile components, such as the oil and hydrocarbon gases, a solid material remains which is referred to as "retorted carbon containing solids". This material contains residual carbonaceous material which may be burned to yield heat energy. The heat recovered from this residual carbonaceous material may be used to supply heat for the pyrolysis of the fresh carbon containing solids in the retorting process.

The inorganic residue that remains after the combustion of the retorted carbon containing solids is called "ash". This material is recycled in some retorting processes as "heat carrier material", i.e., the hot ash from the combustor is mixed with raw carbon containing solids and the heat provided is used for retorting the raw material. See for example U.S. Pat. No. 4,199,432. In processes such as this the maximum size of the particles leaving the retort vessel is usually about 0.5 inch or smaller.

In the case of retorted oil shale, during combustion of the residual carbon to produce heat, the physical integrity of the shale particles is changed, and a substantial amount of fine grained burned shale is produced which is not suitable for use as recycled heat carrier particles because such fine particles would be entrained by the product vapor in the retort. Therefore, it is necessary to separate this fine material prior to recycling the coarser grained particles.

In process schemes using a liftpipe combustor to burn the residual carbonaceous material in the retorted carbon containing solids sufficient residence time is required to assure adequate heat transfer between the hot burning particles and the cooler substantially inert heat carrier particles and suitable conversion of the fuel to environmentally acceptable combustion products. In order to achieve the required residence time in the combustion zone a long liftpipe is usually required.

The present invention is directed to an efficient process for burning the particulate retorted carbon containing solids, especially retorted oil shale, and for separating the fine particles of burned shale prior to recycling a coarse fraction of the burned shale back into the retort process.

SUMMARY OF THE INVENTION

The invention concerns a process for retorting a particulate carbon containing solid in a retorting zone using a heat carrier material heated by burning particulate retorted carbon containing solids containing residual carbonaceous material which comprises:

(a) introducing the retorted carbon containing solids from the retorting zone into the bottom of a vertical combustion zone characterized by an upwardly flowing gas stream containing oxygen and having a velocity sufficient to raise the particles to the top of the combustion zone, whereby the particles are pneumatically entrained and carried upward by the gas stream;

(b) burning at least part of the carbonaceous residue in the retorted carbon containing solids during its passage from the bottom to the top of said vertical combustion zone;

(c) burning the remaining carbonaceous residue in a second combustion zone containing an atmosphere having at least a stoichiometric amount of oxygen present and further having an upward flow of gas directed through the burning particles, said gas flow having a velocity not exceeding the entraining velocity of a preselected size of particles; and (d) recovering from the second combustion zone particles of a size equal to or larger than said preselected size.

DETAILED DESCRIPTION OF THE INVENTION

Figure 1:
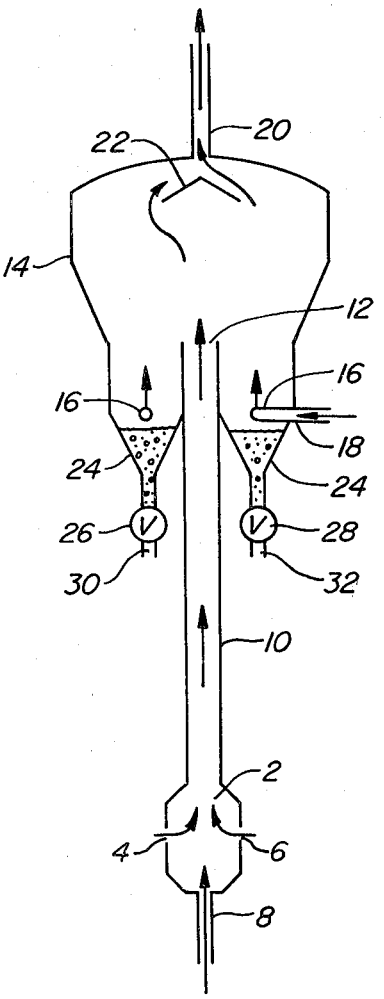
FIG. 1 is a cross-sectional view of a combustion device suitable for use in burning retorted oil shale.

Referring to FIG. 1, oil shale from the retorting process consisting of retorted oil shale containing carbonaceous residue and heat carrier material containing substantially no carbonaceous material enters the engaging area 2 by way of shale inlets 4 and 6. An entraining gas containing oxygen enters the engaging area via air conduit 8. The velocity of gas is sufficient to pneumatically entrain all of the particles of oil shale and carry them up the length of liftpipe 10 where the residual carbonaceous material in the retorted oil shale is at least partially burned. During the passage of the particles up the liftpipe 10 the combustion heat is partially transferred from the hot burning particles to the cooler heat carrier particles. The oil shale particles leave the liftpipe through its open upper end 12 and enter the second combustion chamber 14 where the carbonaceous material remaining in the shale is burned. In addition, any combustible flue gas not burned in the liftpipe due to the short residence time and lower temperature is burned in the second combustion chamber. During the passage of the particles up the liftpipe 10, the combustion heat is partially transferred from the hot burning shale particles to the cooler heat carrier particles. The second combustion chamber contains a concentric-ring gas distributor 16 into which a gas containing oxygen, usually air, is introduced via air conduit 18. An air stream having a velocity about equal to the entraining velocity of a preselected size of burned shale is directed by way of the concentric-ring gas distributor 16 upward into the second combustion chamber. Fine particles of burned shale in the second combustion chamber, i.e. those particles smaller than the preselected particle size, are entrained by the gas stream and carried upward and eventually out of the second combustion chamber via the flue gas outlet 20. A deflection plate 22 serves to prevent larger particles of shale leaving the liftpipe 10 from entering the flue gas outlet. Most larger particles, however, decelerate and drop downward without impacting on the deflection plate. Particles of burned oil shale larger than the preselected size fall past the concentric-ring gas distributor 16 and to the bottom of the second combustion chamber 14 and are collected by a solids collection bin 24. The level of burned oil shale in the collection bin is controlled by valves 26 and 28 which communicate with their respective solids outlets 30 and 32 through which the coarse particles of burned oil shale are withdrawn for recycling as heat carrier material or for disposal of excess material.

Figure 2:
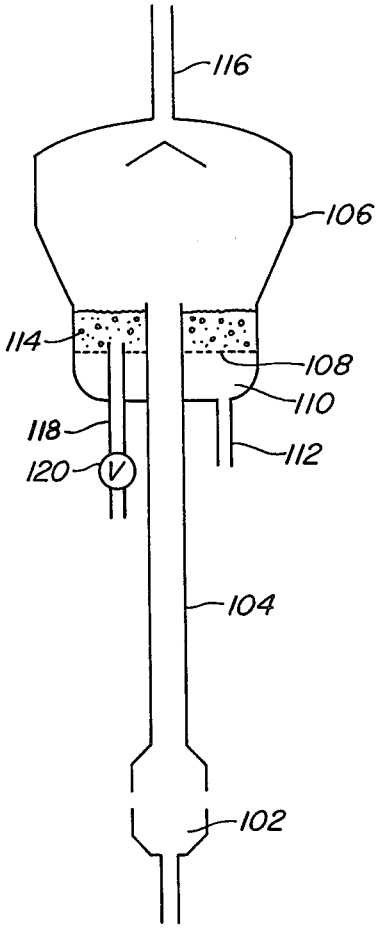
FIG. 2 is a cross-sectional view of a device similar to the device of FIG. 1, but using a fluidized bed of oil shale in the second combustion zone.

The combustor shown in FIG. 2 is very similar to that just described having a solids engaging area 102, a liftpipe combustor 104, and a second combustion chamber 106 also serving as a size segregator. The principal difference lies in the absence of the concentric-ring gas distributor and the solids collection bin. The combustor of FIG. 2 has a perforated plate 108 through which a fluidizing gas passes in jets from a gas distribution chamber 110. Gas enters the gas distribution chamber via gas inlet 112. No solids can enter the gas distribution chamber during operation because of the gas jets. A fluidized bed of burned and burning shale 114 is thus formed at the lower end of the second combustion chamber. Fine particles having an entraining velocity less than the velocity of the fluidizing gas are entrained and carried away via off gas outlet 116. The coarse material in the fluidized bed is drawn off through solids drain 118 controlled by valve 120 and recycled as heat carrier material or disposed of. An advantage of the fluidized bed of FIG. 2 over the system of FIG. 1 is the additional residence time for the solids. The fluidized bed is capable of completely burning material with slower combustion kinetics, such a larger particles of retorted shale, than the design of FIG. 1.

Figure 3:
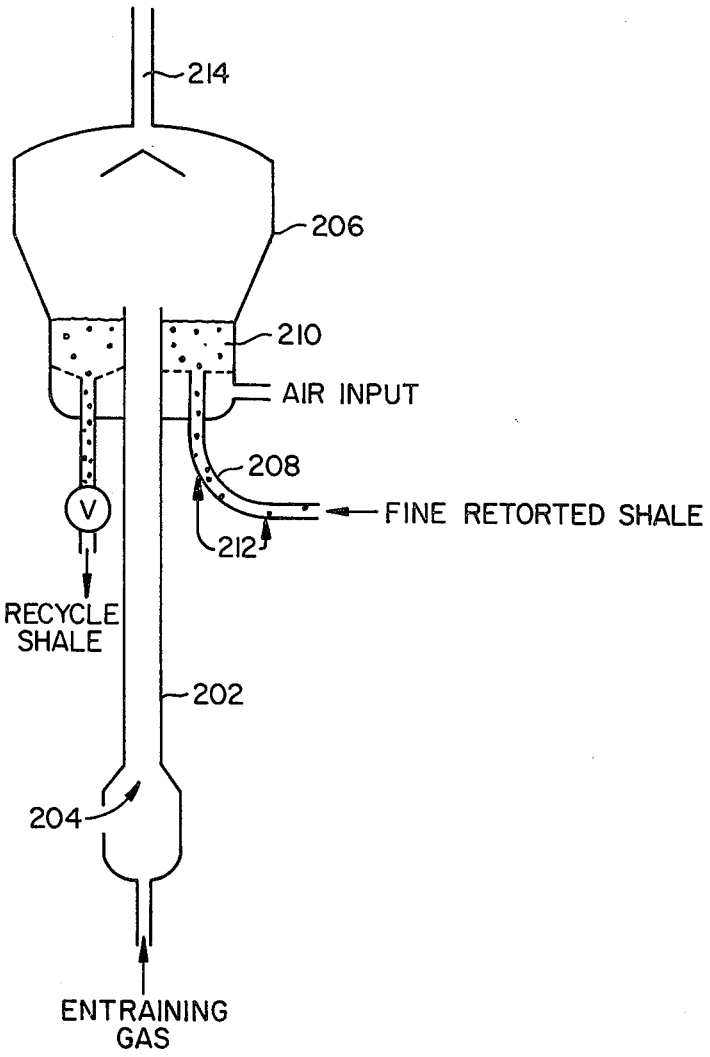
FIG. 3 is a cross-sectional view of an alternate embodiment of the invention wherein a separate feedpipe for fine grain material is present.

The combustor shown in FIG. 3 differs from that of FIG. 2 in that fine particles of retorted shale enter the second combustion chamber directly via a separate feedstream from the rest of the retorted shale. In this embodiment the bulk of the retorted shale including all of the coarser grained fraction enter the liftpipe 202 via inlet 204. A finer fraction of retorted shale, as for example fines carried off with the product vapors leaving the retort and subsequently separated, are fed directly into the second combustion chamber 206 through feedpipe 208 where the fines are mixed with the rest of the shale in fluidized bed 210. Usually the fine retorted shale is transported through feed pipe 208 in a fluidized state by means of aeration inlets 212. This design is advantageous in that the residence time of the fine shale particles in the combustion zone is increased thus allowing more time for complete combustion of the fines and more time to reach thermal equilibrium before exiting the second combustion zone via off gas outlet 214.

In carrying out the process that is the subject of this invention, combustion in the vertical liftpipe may be carried out in either the stoichiometric or substoichiometric mode, i.e. with sufficient oxygen to support complete combustion of the carbonaceous residue or, alternatively, in an oxygen lean atmosphere. In the latter mode of operation sufficient oxygen is added to the second combustion zone to bring the overall process, i.e., both first and second zones, to stoichiometric or excess oxygen level.

Incomplete combustion products formed in the vertical combustion zone are burned in the second combustion zone prior to leaving the combustor. Thus noxious gases such as ammonia, hydrogen cyanide and carbon monoxide formed in the vertical combustion zone are burned in the second combustion zone to environmentally acceptable gases. In addition, it has been found that in circumstances where the oxides of nitrogen may be formed during combustion the amount of these noxious gases that are released will be minimized by operation of the vertical combustion zone in the substoichiometric mode, i.e. oxygen lean, followed by operation with stoichiometric or excess oxygen in the second zone. Furthermore, the efficient contacting between gas and solids that are characteristic of the process of this invention leads to efficient utilization of gas/solid interactions to control noxious gas release. For example, sulfur oxides have been found to react with the calcium and magnesium oxides formed from the corresponding carbonates in burned shale to produce a flue gas containing essentially no sulfur oxides.

Particles smaller than about 100 mesh size (Tyler standard), i.e. about 150 microns in diameter, are usually not suitable for use in the retorting process. Therefore, particles below this range are preferably removed with the flue gas in the second combustion zone as entrained fines. The separation of the fine and coarse particles is inherent in the practice of the invention provided the flow of gas in the second combustion zone equals or exceeds the entraining velocity of the fine material. It should be understood the terms "fine" and "coarse" are relative terms, the size of which may vary somewhat depending upon the exact details of how the retorting process is carried out. Thus, in process schemes where particles smaller than 100 mesh cannot be tolerated in the recycle stream, the term fine may include particles smaller than 100 mesh. Likewise, under other circumstances where particles of a larger minimum mesh size may be tolerated the definition of "fine" may be adjusted accordingly.

The flow of gas passing up the vertical combustion zone must be above the choking velocity of the oil shale entering at the bottom of the zone, i.e. the gas velocity must be sufficient to entrain all particles entering the zone. Excessive velocities are usually undesirable because any increase in gas velocity is accompanied by an increase in particle attrition. This translates into a relatively narrow gas velocity operating range for a single stage liftpipe combustor. However, the present invention utilizes a second combustion zone which allows a much wider operating range for the combustor.

In a process wherein the maximum particle size is about 3 mesh (7 mm diameter) a gas velocity of at least about 50 feet per second is required to prevent choking. At the same time velocities in excess of 150 feet per second are generally undesirable because of increased particle attrition. Generally, velocities in the range of from about 110 feet per second to about 120 feet per second are preferred for a maximum particle size of 3 mesh. A smaller maximum particle size would allow a lower velocity.

In the second combustion zone lower gas velocities are employed to separate the fine material from the coarser grain material. Usually, the gas velocity at the top of the second combustion zone ranges from about 1 to about 20 feet per second. If a cut size of about 100 mesh is desired a superficial gas velocity of about 4 feet per second is required in the upper part of the second combustion zone. The precise velocity selected for carrying out the second stage combustion and separation of particles will depend on the design of the combustor.

As used in the specification and claims the phrase entraining gas velocity refers to the minimum velocity of a gas stream necessary to entrain a given size of particle in a given environment.

The process of this invention is advantageously used in an oil shale retorting process employing recycled burned shale as the heat carrier material. This method for combusting the residual carbonaceous material in the retorted oil shale is particularly advantageous, when in the retorting process raw oil shale and heat carrier material are contacted in a downward moving bed. In this instance, the combustor may be incorporated directly into the retort vessel. The second combustion zone would be located in a directly superior position to the retorting vessel and can be made to feed the recyclable coarse shale particles directly into the top of the retort. Likewise, the retorted shale in the bottom of the retort vessel can be fed directly into the bottom of the vertical combustion zone.

One skilled in the art will recognize that other schemes utilizing this invention can be devised to employ various other types of heat transfer material, such as for example ceramic compositions, sand, alumina, steel, or the like. Even in processes using burned shale as the principal heat carrier material, it is often necessary to add supplemental heat carrier material to the system. In either instance, the supplemental heat transfer material is simply mixed with the feed at the bottom of the vertical combustion zone. Otherwise, the operation is the same as already described.

EXAMPLE

In a module for producing 10,000 barrels per day of shale oil using the combustor as shown in FIG. 1, the first stage liftpipe is 60 feet long and 3½ feet in diameter and operates with a 50% stoichiometric amount of oxygen to achieve partial combustion of the carbonaceous residue during the residence time in the liftpipe. The second stage combustor expands from 20 feet in diameter at the liftpipe opening to 30 feet at the top. A gas velocity of about 4 feet per second is maintained throughout the second combustion zone. The overall height of the vessel containing the second stage combustion area is 30 feet; this is sufficient to allow deceleration of most particles without impaction on the deflector plate at the top of the second combustion chamber.

What is claimed is:

1. In a process for retorting a carbon containing solid in a retorting zone using a heat carrier material heated by burning particulate retorted carbon containing solids containing residual carbonaceous material which comprises:

(a) introducing a first fraction of retorted carbon containing solid from the retorting zone into the bottom of a vertical combustion zone characterized by an upwardly flowing gas stream containing oxygen and having a velocity sufficient to raise the particles of carbon containing solid to the top of the combustion zone, whereby the particles are pneumatically entrained and carried upward by the gas stream;

(b) burning at least part of the carbonaceous residue in said first fraction of retorted carbon containing solid during its passage from the bottom to the top of said vertical combustion zone;

(c) burning the remaining carbonaceous residue in said first fraction in a fluidized bed containing an atmosphere having at least a stoichiometric amount of oxygen present;

(d) introducing a second fraction of retorted carbon containing solid directly into the fluidized bed and burning the carbonaceous residue therein, said second fraction being of a generally smaller particle size than said first fraction; and (e) recovering burned solids from the fluidized bed.

2. The process of claim 1 wherein a finer fraction of burned particles is recovered in step (e) separately from the rest of the burned solids.

3. The process of claim 1 wherein the burned particles of preselected size recovered from the second combustion zone are used as the heat carrier material.

4. The process of claim 1 wherein the upward gas stream in the vertical combustion zone has a velocity in the range of from about 50 feet per second to about 150 feet per second.

5. Process of claim 4 wherein the velocity is from about 110 to about 120 feet per second.

6. The process of claim 1 wherein the upward flow of gas in the second combustion zone has a velocity in the range of from about 1 to about 20 feet per second.

7. Process of claim 1 wherein the combustion in the vertical combustion zone is carried out with a substoichiometric amount of oxygen.

8. Process of claim 1 wherein the particles of retorted carbon containing solid introduced into the bottom of the vertical combustion zone are no larger than about 0.5 inch.

9. The process of claim 1 wherein the carbon containing solid is oil shale.

* * * * *